US005460869A

United States Patent [19]

McKeon

[11] Patent Number: 5,460,869

[45] Date of Patent: Oct. 24, 1995

[54] POLYESTER MONOFILAMENT AND PAPER MAKING FABRICS HAVING IMPROVED ABRASION RESISTANCE

[75] Inventor: Timothy E. McKeon, Columbia, S.C.

[73] Assignee: Shakespeare Company, Columbia, S.C.

[21] Appl. No.: 306,106

[22] Filed: Sep. 14, 1994

Related U.S. Application Data

[62] Division of Ser. No. 106,272, Aug. 12, 1993, Pat. No. 5,407,736.

[51] Int. Cl.[6] ..... D03D 3/00

[52] U.S. Cl. ..... 428/227; 139/383 A; 139/426; 428/225; 162/902

[58] Field of Search ..... 139/383 A, 426; 428/225, 227; 524/513; 162/902

[56] References Cited

U.S. PATENT DOCUMENTS

| | | | |
|---|---|---|---|
| 3,005,795 | 10/1961 | Busse et al. | 260/45.5 |
| 3,294,871 | 10/1966 | Schmitt et al. | 260/900 |
| 3,723,373 | 3/1973 | Lucas | 260/29.6 |
| 4,191,678 | 4/1980 | Smith | 260/40 R |
| 4,610,916 | 9/1986 | Ballard | 428/224 |
| 5,283,110 | 2/1994 | Gardner et al. | 428/227 |
| 5,297,590 | 3/1994 | Fleisher | 139/383 A |

OTHER PUBLICATIONS

"Polyethylene terephthalate: PET, standard grades" Oct. 1991, *Modern Plastics* TEFZEL© HT-2127; Technical Information; DuPont; 4 pages–undated.

*Primary Examiner*—James J. Bell

*Attorney, Agent, or Firm*—Renner, Kenner, Greive, Bobak, Taylor & Weber

[57] ABSTRACT

A polyester monofilament which exhibits improved abrasion resistance and is formed from the extrusion of a polymer blend of a polyester resin and a melt extruded fluoropolymer resin. The monofilament exhibits an improved resistance to abrasion as compared to standard high temperature polyester monofilament.

6 Claims, No Drawings

POLYESTER MONOFILAMENT AND PAPER MAKING FABRICS HAVING IMPROVED ABRASION RESISTANCE

This application is a division of application Ser. No. 08/106,272, filed Aug. 12, 1993 U.S. Pat. No. 5,407,736.

TECHNICAL FIELD

The present invention relates to a polyester monofilament, such as may be useful as a component of fabrics for paper-making machines, and specifically for the forming and dryer sections thereof. More particularly, the present invention relates to a polyester monofilament having improved toughness and abrasion resistance as compared to standard polyester monofilaments. This increased toughness and resistance to abrasion is accomplished by the addition of a melt extruded fluoropolymer resin to a polyester resin to form a melt extruded polymer blend suitable for the production of a polyester monofilament.

BACKGROUND OF THE INVENTION

Polyester resins such as polyethylene terephthalate (hereinafter PET) and the like are well known thermoplastic materials commonly used in the production of monofilaments. These monofilaments are frequently woven into support belts or fabrics for transporting and dewatering paper sheets produced by paper-making machines. While in use, these fabrics are subject to demanding conditions which mechanically wear and abrade the monofilaments from which the fabrics are made. As a result, paper-making fabrics which are comprised of polyester monofilaments generally may require replacement within about 30 to 60 days on wear prone forming positions. Nylon monofilaments are often used in combination with polyester monofilaments on high wear positions. The use of nylon may cause some problems in this type of usage due to its high moisture absorption. Accordingly, polyester monofilaments having an increased resistance to abrasion have long been sought by those in the paper-making industry.

It has long been known in the art to blend certain fluoropolymers with various thermoplastic resins to achieve a number of desired results. For example, Busse et al. U.S. Pat. No. 3,005,795 teach the blending of polytetrafluoroethylene (hereinafter PTFE) in powder form to various thermoplastic polymers such as methacrylate polymers, styrene polymers, and polycarbonates. Schmitt et al. U.S. Pat. No. 3,294,871 teaches the blending of PTFE in latex form to various thermoplastic polymers including those mentioned hereinabove. However, in both of these patents, the blends included finely divided microfibrous particles of PTFE which are not suitable for producing monofilaments as discussed hereinbelow.

At least two patents have blended PTFE with a polyester resin. Notably, Lucas U.S. Pat. No. 3,723,373 teaches the addition of a PTFE emulsion to polyethylene terephthalate (PET) to achieve a material which has greater elongation and improved impact strength. The PTFE emulsion is merely PTFE in the form of a latex dispersion or emulsion with water, mineral oil, benzene or the like. Accordingly, the PTFE emulsion also includes particles of about 0.1 micron to about 0.5 microns in size which comprise about 30 to 80 percent of the emulsion. The PTFE emulsion forms about 0.1 to 2.0 percent by weight of the blend, based upon the weight of the PET. Furthermore, Lucas indicates that this material can be extruded into sheet or stock shapes at a temperature of around 260° C.

Similar to Lucas, Smith U.S. Pat. No. 4,191,678 relates to a fire retardant polymer blend comprising an aqueous colloidal dispersion of PTFE and a polyester resin. Again, however, the PTFE in the dispersion has an average particle size of about 0.2 microns. Smith also indicates that the blend may be subsequently extruded at about 240° C.

The extrusion temperatures of these blends have been noted because it is well known that the melt temperature of PTFE is between about 335° C. and about 343° C. (635°–650° F.), and therefore, when PTFE and the polyester resin are extruded under standard operating conditions at temperatures below 320° C., such as taught by at least one of the above-identified patents, it is clear that the PTFE in the blend must be in the form of solid particles and not in the form of a liquid melt. Importantly, such blends having PTFE in particle form have been found to produce monofilament which are insufficient for use in paper maker fabrics. The monofilaments are very difficult to extrude because the particles can easily clog or otherwise damage the extrusion equipment which is geared toward producing monofilaments from melted blends. Additionally, when monofilaments are produced from these blends, they have been found to be very rough and not suitable for use in paper maker fabrics. Furthermore, and possibly even more importantly, the PTFE retains its useful properties only up to about 287° C. (550° F.). Accordingly, by melting the PTFE at higher temperatures, all advantages gained by the inclusion of PTFE in these blends would be lost.

Thus, the need exists for a polyester monofilament having improved toughness and abrasion resistance which may be produced from a polymer blend of a polyester resin and a melt extrudable fluoropolymer under standard operating conditions.

SUMMARY OF INVENTION

It is therefore a primary object of the present invention to provide a polyester monofilament having improved toughness and resistance to abrasion over conventional polyester monofilaments.

It is another object of the present invention to provide a monofilament, as above, having a fluoropolymer component which may be extruded at temperatures above its melting temperature.

It is a further object of the present invention to provide a paper-making machine fabric formed from a plurality of polyester monofilaments having improved resistance to abrasion.

At least one or more of the foregoing objects of the present invention, together with the advantages thereof over existing monofilaments and products thereof, which shall become apparent from the specification which follows, are accomplished by the invention as hereinafter described and claimed.

In general, a polyester monofilament which exhibits increased resistance to abrasion comprises a polymer blend including at least about 80 percent by weight of a standard polyester resin; and up to about 20 percent by weight of a melt extruded fluoropolymer resin, to form 100 percent by weight of the polymer blend.

The present invention also provides a paper machine fabric which comprises a plurality of woven polyester monofilaments having improved resistance to abrasion, these monofilaments being comprised of a polymer blend of at least about 80 percent by weight of a polyester resin and up to about 20 weight percent of a melt extruded fluoropolymer resin, to form 100 percent by weight of the polymer blend.

PREFERRED EMBODIMENT FOR CARRYING OUT THE INVENTION

The present invention is directed toward a polyester monofilament comprising a polymer blend of a polyester resin and a melt extruded fluoropolymer. It has been found that such a monofilament has improved resistance to abrasion over conventional polyester monofilaments.

Polyester resins useful in the present invention include those thermoplastic polyester resins such as polyethylene terephthalate (PET) which may be readily extruded to form monofilaments under standard processing conditions. PET may be formed from ethylene glycol by direct esterification or by catalyzed ester exchange between ethylene glycol and dimethyl terephthalate. Other processes for producing PET may also be available and well known in the art. Polyester resins such as PET are suitable for use in forming monofilaments, because they have dimensional stability and low moisture regain in forming and dryer fabrics. Conventional PET monofilaments are also known to provide low resistance to abrasion when compared to nylon monofilaments.

An example of a polyester resin useful in the present invention is a standard PET such as produced by E. I. du Pont de Nemours & Co. under the trademark CRYSTAR. This particular PET has a melt temperature of about 257° C. and an intrinsic visocity of about 0.95.

The polymer blend which forms the monofilaments of the present invention further includes a melt extruded fluoropolymer. By the term "melt extruded", it is meant that, in the extrusion process, the fluoropolymers melt and become a liquid under standard processing conditions. Typically, standard processing conditions do not involve temperatures above about 320° C. Accordingly, the fluoropolymers employed in the present invention have a melt temperature below about 320° C. and preferably melt within the normal extrusion operating temperature range of about 170° C. to 320° C., and even more desirably within the range of about 250° C. to 280° C. Therefore, at normal operating temperatures, the entire blend of polyester resin and fluoropolymer additive will be in the melt phase and is melt processible.

Fluoropolymers useful in the present invention are typically copolymers of ethylene and halogenated ethylene, although they are not necessarily limited thereto. More specifically, examples of fluoropolymers useful in the present invention and having melt temperatures below about 320° C. include ethylene tetrafluoroethylene copolymers such as those produced by E. I. du Pont de Nemours & Co., of Wilmington, Del., under the trademark TEFZEL; tetrafluoroethylene hexafluoropropylene copolymers such as those produced by E. I. du Pont de Nemours & Co. under the trade name TEFLON FEP; and polyfluoroalkoxy copolymers such as those produced by E. I. du Pont de Nemours & Co. under the trade name TEFLON PFA. In addition, polyvinylidene fluoride copolymers and ethylene chlorotrifluoroethylene copolymers may also be a suitable fluoropolymer for extrusion purposes.

All of the fluoropolymers mentioned hereinabove melt in the temperature range of about 170° C. to 320° C., and therefore, are in the liquid phase, along with the polyester resin employed, when extruded at temperatures below about 320° C. Notably, TEFZEL melts between about 245° C. to 280° C.; TEFLON FEP melts within the range of about 260° C. to 285° C.; and TEFLON PFA melts between about 300° C. and 310° C. Additionally, polyvinylidene fluoride copolymers and ethylene chlorotrifluoroethylene copolymers melt below 320° C.

It should be understood that any polyester resin and melt extrudable fluoropolymer resin suitable for the functional requirements described herein may be used in the present invention, and any examples provided herein are not intended to limit the present invention to those particular resins or to those particular amounts, unless otherwise indicated.

About 0.2 to about 20 percent by weight of the desired fluoropolymer is blended with a complementary amount of polyester resin, preferably, about 80 to about 99.8 percent by weight, to achieve 100 percent by weight of the polymer blend. The polymer blend may then be extruded, preferably by a process of melt extrusion at temperatures below about 320° C., to produce the improved abrasion resistant polyester monofilament of the present invention. Additives such as hydrolytic and thermal stabilizers and the like may also be blended therein as needed in amounts suitable and effective for their purpose.

Polyester monofilaments prepared according to the present invention have been found to have up to about 400 percent greater resistance to flexural abrasion and up to about 45 percent greater resistance to abrasion in a sandpaper abrader. These abrasion resistant polyester monofilaments have utility in the production of products such as paper machine fabrics. A plurality of these monofilament can be interwoven as is commonly known in the art. Such fabrics produced from these monofilament exhibit improved toughness and abrasion resistance which is a useful property for paper maker fabrics or belts and adds to the operational life of the fabrics or belts.

MONOFILAMENT EXAMPLES

In order to demonstrate the practice of the present invention, tests for abrasion resistance were performed on several monofilaments prepared according to the present invention and compared to the abrasion resistance of standard PET monofilaments. In addition, these tests were also compared with abrasion resistance tests performed on monofilaments prepared from PET containing 2 percent PTFE.

The standard PET monofilament consisted essentially of PET. More particularly, DuPont 0.95 IV CRYSTAR polyester resin was extruded by a standard melt extrusion process at a process temperature of between about 290° C. and 320° C. (555°–610° F.) to form suitable monofilaments. The abrasion resistance of these monofilaments was then tested using a squirrel cage fatigue test and a sandpaper abrasion test as detailed hereinbelow. The results of these tests for the 100 percent PET monofilament are reported in Table I hereinbelow under the heading "Control".

Polymer blends were then produced by adding varying amounts of various fluoropolymers to the same PET material as was used for the control PET monofilament. In particular, 0.2, 0.5, 2, and 5 percent by weight TEFZEL HT-2162 powder (ethylene tetrafluoroethylene) were added, respectively, to produce four of the monofilaments of the present invention. Two and 5 percent by weight TEFZEL 750 pellets (ethylene tetrafluoroethylene), and 2 and 5 percent by weight PFA 340 pellets polyfluoroalkoxy, were added to produce four more monofilaments of the present invention, respectively. In addition, two separate monofilaments, one produced at a higher processing temperature than the other, were produced using 2 percent by weight FEP 100 pellets (tetrafluoroethylene hexafluoro-propylene). Accordingly, a total of ten monofilaments were produced according to the present invention.

Two other monofilaments were also formed. These monofilaments were produced by adding 2 percent by weight MP-1000 powder, a PTFE available from E. I. du Pont de Nemours, to the CRYSTAR PET resin. Again, one of these filaments was produced at a higher processing temperature than the other. Thus, a total of fifteen monofilaments were produced.

Notably, each of these monofilaments was extruded at temperatures below about 320° C. The operating conditions, such as processing temperature ranges, for each of the monofilaments are shown in Table I hereinbelow.

TABLE I

OPERATING CONDITIONS

| Trial No. | Additive To PET | Processing Temp. Range (°F.) | Comments |
|---|---|---|---|
| 1 | Control | 550–555 | |
| 2 | 0.2% TEFZEL Powder | 550–555 | |
| 3 | 0.5% TEFZEL Powder | 550–555 | |
| 4 | 2% TEFZEL Powder | 550–565 | |
| 5 | 5% TEFZEL Powder | 550–565 | |
| 6 | 2% TEFZEL Pellets | 555–570 | |
| 7 | 5% TEFZEL Pellets | 555–570 | |
| 8 | 2% PFA Pellets | 585–605 | Slight die face build-up |
| 9 | 5% PFA Pellets | 590–615 | |
| 10 | 2% FEP Pellets | 565–580 | Some die face build-up |
| 11 | 2% FEP Pellets | 575–590 | |
| 12 | 2% MP-1000 Powder | 565–580 | Very rough, die face build-up |
| 13 | 2% MP-1000 Powder | 575–590 | Very rough, die face build-up |

Each of the monofilaments produced was subjected two types of physical tests. Squirrel cage fatigue tests were conducted in a squirrel cage abrader which consists of twelve equally spaced carbon steel bars on an approximately 14.2 cm diameter bolt circle rotating about a common axis. Each bar is about 3.8 mm in diameter and about 24.8 cm long with its axis parallel to a central axis. Each monofilament is tied to a microswitch by means of a slip knot and then draped over the bars and pretensioned with a free hanging weight. The microswitch is pretensioned so that a maximum of about 19 cm of monofilament is contacted by the bars at any one time. The free hanging weights weigh 500 grams each and up to eight monofilament strands can be tested at one time. The bars rotate about the common axis at 100 rpm, and the test is continued until the monofilaments are severed. The life of the monofilament while on the squirrel cage is measured in cycles to break, which represents the revolutions required to severe the monofilament.

Sandpaper abrasion test equipment consists of a continuously moving strip of sandpaper wrapped more than 180° around a support roll (3.2 cm diameter). The axis of the support roll is parallel to the floor. Guide rollers allow the test monofilament to contact 3.5 linear cm of sandpaper. The 320J grit sandpaper moves at 4 inches per minute in a direction that results in an upward force on the monofilament. A downward force is maintained by tensioning the monofilament with 250 grams of free hanging weight. The monofilament cycles clockwise and counterclockwise on the sandpaper with a traverse length of 3 cm. The filament is strung across a microswitch which stops when the filament breaks. Results are recorded as cycles to break.

Each of the monofilaments was subjected to squirrel cage fatigue testing and sandpaper abrasion testing, the results of which have been presented in Table II hereinbelow.

TABLE II

PHYSICAL PROPERTIES
Abrasion Resistance as a Function of the Additive

| Additive | Wt. % Additive | Squirrel Cage (cycles) | Sandpaper (cycles) |
|---|---|---|---|
| Control | 0 | 4082 | 148 |
| TEFZEL Powder | .2 | 6818 | 181 |
| TEF2EL Powder | .5 | 5371 | 202 |
| TEFZEL Powder | 2 | 12532 | 187 |
| TEFZEL Powder | 5 | 16225 | 205 |
| TEFZEL Pellets | 2 | 5518 | 197 |
| TEFZEL Pellets | 5 | 7357 | 178 |
| TEFLON PFA PELLETS | 2 | 3052 | 172 |
| TEFLON PFA PELLETS | 5 | 4833 | 187 |
| FEP Pellets | 2 | 6807 | 188 |
| FEP Pellets | 2 | 5205 | 215 |
| TEFLON MP-1000 PTFE | 2 | 6271 | 199 |
| TEFLON MP-1000 PTFE | 2 | 4406 | 166 |

As shown in Table II, the extruded monofilaments of the present invention had up to about 400 percent greater resistance to flexural abrasion in the squirrel cage abrader and up to about 45 percent greater resistance to abrasion in the sandpaper abrader as compared to the PET monofilament (Control). Moreover, the monofilaments comprised of ethylene tetrafluoroethylene copolymers and PET produced at least 32 percent greater resistance to flexural abrasion in every instance and at least 20 percent greater resistance to sandpaper abrasion in every instance. All but one of the other monofilaments of the present invention had improved squirrel cage abrasion resistance, and each of these monofilament had a greater resistance to abrasion in the sandpaper abrader of between 15 and 45 percent. The PET/PTFE monofilaments also showed increased resistance to abrasion. However, as indicated in Table I, these monofilaments were very rough and wholly unsuitable for use in paper machine fabrics.

In conclusion, it should be clear from the foregoing examples and specification that the fluoropolymer blended polyester monofilaments of the present invention exhibit improved abrasion resistance over the pure PET monofilament. It should also be noted that the monofilaments produced by blending PTFE with PET yielded poor monofilaments which, due to their rough texture, could not be used to make monofilaments suitable for use in fabrics. Moreover, the solid particles of PTFE collected in the fine screen employed to filter the extrusion product thereby causing undesirable pressures to build within the extruder. Therefore, although a slight increase in abrasion resistance was observed with the PTFE additive, the results were not based on melt extruded PTFE, and therefore, are not wholly comparable with the results of the monofilaments of the present invention.

Similarly, practice of the process of the present invention should not necessarily be limited to the use of a particular extruder, extrusion temperatures, quench temperature, draw ratio, relaxation ratio or the like that may be employed to extrude monofilament. It should be understood that accommodations for differences in equipment, the size and shape of the monofilament, and other physical characteristics of the monofilament of the present invention other than those expressly noted herein are not relevant to this disclosure, can readily be made within the spirit of the invention.

Lastly, it should be appreciated that the monofilament described herein has utility in woven fabric such as is useful as paper machine fabric. The fabric woven from the monofilament with improved abrasion resistance exhibits longer life and improved wear resistance compared to fabrics woven from pure polyester monofilament.

Based upon the foregoing disclosure, it should now be apparent that the use of the monofilament and fabric described herein will carry out the objects set forth hereinabove. It is, therefore, to be understood that any variations evident fall within the scope of the claimed invention and thus, the selection of specific component elements can be determined without departing from the spirit of the invention herein disclosed and described. Thus, the scope of the invention shall include all modifications and variations that may fall within the scope of the attached claims.

What is claimed is:

1. A paper machine fabric comprising:

a plurality of woven polyester monofilaments, each said monofilament having improved abrasion resistance as compared to conventional polyester monofilaments and comprising a polymer blend of polyethylene terephthalate and a melt extruded fluoropolymer resin, said polymer blend comprising at least about 80 percent by weight of said polyethylene terephthalate and up to about 20 percent by weight of said fluoropolymer resin, to form 100 percent by weight of said blend.

2. A paper machine fabric, as in claim 1, wherein said polymer blend includes from about 80 to about 99.8 percent by weight of said polyethylene terephthalate.

3. A paper machine fabric, as in claim 1, wherein said polymer blend includes from about 0.2 to about 20 percent by weight of said fluoropolymer resin.

4. A paper machine fabric, as in claim 1, wherein said fluoropolymer resin has a melt temperature below about 320° C.

5. A paper machine fabric, as in claim 4, wherein said fluoropolymer resin melts at temperatures of between about 170° C. to 320° C.

6. A paper machine fabric, as in claim 1 wherein said fluoropolymer resin is selected from the group consisting of ethylene tetrafluoroethylene copolymers, polyvinylidene fluoride copolymers, tetrafluoroethylene hexafluoropropylene copolymers, and polyfluoroalkoxy copolymers, and ethylene chlorotrifluoroethylene copolymers.

* * * * *